US008541355B2

(12) United States Patent
Fleckenstein et al.

(10) Patent No.: US 8,541,355 B2
(45) Date of Patent: Sep. 24, 2013

(54) PROCESS TO PRODUCE STABLE SUSPENDING SYSTEM

(75) Inventors: Melissa Marie Fleckenstein, Clark, NJ (US); Deborah Ann Peru, Lebanon, NJ (US); Kevin Mark Kinscherf, Middletown, NJ (US); Robert Tavares, Dunellen, NJ (US); Cynthia Murphy, Belle Mead, NJ (US); Dipak Patel, Parsippany, NJ (US); John Pettinari, Washington, NJ (US); Robert D'Ambrogio, Princeton, NJ (US); Jodie Berta, Parsippany, NJ (US); Andrei Potanin, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 13/505,910

(22) PCT Filed: Nov. 4, 2010

(86) PCT No.: PCT/US2010/055424

§ 371 (c)(1),
(2), (4) Date: May 3, 2012

(87) PCT Pub. No.: WO2011/056953

PCT Pub. Date: May 12, 2011

(65) Prior Publication Data

US 2012/0214725 A1 Aug. 23, 2012

Related U.S. Application Data

(60) Provisional application No. 61/257,885, filed on Nov. 4, 2009, provisional application No. 61/257,876, filed on Nov. 4, 2009.

(51) Int. Cl.
*C11D 1/00* (2006.01)
*C11D 3/22* (2006.01)

(52) U.S. Cl.
USPC ..... 510/405; 510/418; 510/470; 510/471; 134/25.2; 134/25.3; 134/39; 134/42

(58) Field of Classification Search
USPC ..... 510/405, 418, 470, 471; 134/25.2, 134/25.3, 39, 42
See application file for complete search history.

(56) References Cited

U.S. PATENT DOCUMENTS

| | | | | |
|---|---|---|---|---|
| 2,785,765 | A | 3/1957 | Cornell | |
| 4,018,720 | A | 4/1977 | Lengyel et al. | |
| 4,772,425 | A | 9/1988 | Chirash et al. | |
| 4,871,251 | A | 10/1989 | Preikschat et al. | |
| 4,929,380 | A * | 5/1990 | Schulz et al. | 510/413 |
| 4,992,107 | A | 2/1991 | Itoku et al. | |
| 5,188,752 | A | 2/1993 | Prencipe et al. | |
| 5,252,244 | A | 10/1993 | Beaujean et al. | |
| 5,510,047 | A * | 4/1996 | Gabriel et al. | 510/221 |
| 5,619,043 | A | 4/1997 | Preikschat et al. | |
| 5,815,264 | A | 9/1998 | Reed et al. | |
| 6,258,771 | B1 | 7/2001 | Hsu et al. | |
| 6,274,539 | B1 | 8/2001 | Kacher et al. | |
| 6,274,540 | B1 | 8/2001 | Scheibel et al. | |
| 6,336,977 | B1 | 1/2002 | Menke et al. | |
| 6,380,150 | B1 | 4/2002 | Toussaint et al. | |
| 6,449,042 | B1 | 9/2002 | Hamann | |
| 6,767,878 | B1 | 7/2004 | Paye et al. | |
| 6,940,064 | B2 | 9/2005 | Hamann | |
| 7,098,178 | B2 | 8/2006 | Gerke et al. | |
| 2003/0109391 | A1 | 6/2003 | Midha et al. | |
| 2004/0018950 | A1 | 1/2004 | Foley et al. | |
| 2005/0020467 | A1 | 1/2005 | Kinscherf | |
| 2007/0010415 | A1 | 1/2007 | Kinscherf et al. | |
| 2007/0066507 | A1 | 3/2007 | Fleckenstein et al. | |
| 2008/0070823 | A1 | 3/2008 | Gorlin et al. | |
| 2008/0108541 | A1 | 5/2008 | Swazey | |
| 2008/0108714 | A1 | 5/2008 | Swazey et al. | |
| 2008/0146485 | A1 | 6/2008 | Swazey | |
| 2008/0242581 | A1 | 10/2008 | Murphy et al. | |
| 2009/0105113 | A1 | 4/2009 | Tuzi et al. | |
| 2009/0186796 | A1 | 7/2009 | Gomez Ruiz et al. | |
| 2010/0150975 | A1 | 6/2010 | Dihora et al. | |

FOREIGN PATENT DOCUMENTS

| | | |
|---|---|---|
| WO | WO 2004/071322 | 8/2004 |
| WO | WO 2006/041740 | 4/2006 |
| WO | WO 2007/123566 | 11/2007 |
| WO | WO 2008/076753 | 6/2008 |
| WO | WO 2008/079693 | 7/2008 |
| WO | WO 2009/101545 | 8/2009 |
| WO | WO 2009/135765 | 11/2009 |

OTHER PUBLICATIONS

Caggioni et al., 2007, "Rheology and microrheology of a microstructured fluid: The gellan gum case", J. Rheol. 5(15), pp. 851-865.

The Cornell Machine Co. 2004 "Versator Operation and Process Actions", www.cornellmachine.com/versator_operation_process.htm.

CP Kelco, 2008, "CELLULON™ PX microfibrous cellulose blend—prototype formula and FAQs for Liquid Dish Detergents", www.cpkelco.com.

CP Kelco, 2008, "Preparation of CELLULON™ PX microfibrous cellulose blend solutions".

Eiger Torrance Ltd, 2007, "DeAeration Equipment—Versator Product Info", www.eiger-torrance.com/filestore/versator.pdf, created Oct. 2007.

ISR and Written Opinion for PCT/US10/055417 mailed on Feb. 22, 2011.

ISR and Written Opinion for PCT/US10/055421 mailed on Feb. 11, 2011.

ISR and Written Opinion for PCT/US10/055424 mailed on Feb. 22, 2011.

Mettler Toledo, 2008, "In-process high-resolution particle microscopy: Process Analytical Technology (PAT)", www.mnt.com/PVM, Lasentec®, PVM®.

(Continued)

*Primary Examiner* — Brian P Mruk
(74) *Attorney, Agent, or Firm* — Michael F. Morgan

(57) ABSTRACT

A process that degasses a structured surfactant composition that comprises at least one surfactant, water, and at least one suspending agent chosen from polysaccharides, gums, and celluloses. By degassing the composition, the suspending agent can form a structured system. Gas, such as air bubbles, disrupts the formation of the structuring system, which reduces the ability of the composition to suspend materials.

10 Claims, No Drawings

(56) References Cited

OTHER PUBLICATIONS

Mettler Toledo, 2008, "Particle Characterization:Measure Particle Distribution In-Process; Ensure Targeted Granule Size in Real Time", www.mt.com/ibrmc35.

Mettler Toledo, 2009, "FBRM® (FocusedBeam Reflective Measurement) Technology", http://us.mt.com/us/en/home/supportive...content/...sentec-FBRM-Method-of-Measurement.oneColEd.html.

U.S. Appl. No. 13/505,865, filed May 3, 2012, entitled "Microfibrous Cellulose Having a Particle Size Distribution for Structured Surfactant Compositions".

Written Opinion for PCT/US10/055424 mailed on Feb. 14, 2012.

* cited by examiner

PROCESS TO PRODUCE STABLE SUSPENDING SYSTEM

CROSS REFERENCE TO RELATED APPLICATIONS

This application is a national stage entry under 35 U.S.C. §371 of International Patent Application No. PCT/US2010/055424, filed 4 Nov. 2010, which claims priority to U.S. Provisional Patent Application Nos. 61/257,885, filed on 4 Nov. 2009 and 61/257,876, filed on 4 Nov. 2009, both of which are incorporated herein by reference.

BACKGROUND

Structured liquids are known in the art for suspending materials such as beads in liquid cleaning compositions. The methods of providing structure to the liquid includes using particular surfactants to structure the liquid, or by the addition of suspending agents such as polysaccharides, natural gums, or cellulose, that enable the liquid to suspend materials therein for long periods of time. These suspended materials can be functional, non-functional (aesthetic), or both. By aesthetic it is meant that the suspended materials impart a certain visual appearance that is pleasing or eye catching. By functional it is meant that the suspended materials contribute to the action of the composition in cleaning, fragrance release, shine enhancement, or other intended action of the composition.

It has been discovered that surfactant systems structured with polysaccharides, natural gums, or celluloses do not stably suspend materials for an extended period of time, especially materials that are not density matched to the composition. It would be desirable to suspend materials over time.

BRIEF SUMMARY

A process comprising a) mixing at least one surfactant, water, and at least one suspending agent chosen from polysaccharides, gums, and celluloses to form a liquid composition; and b) degassing the composition.

DETAILED DESCRIPTION

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

When mixing a suspending agent into a surfactant containing composition, such as in a rotor-stator homogenizer, gas, such as air, can become entrained in the composition. The mixing can be done in a batch or continuous process.

When the suspending agent is a gum or cellulose, it has been discovered that air interferes with the ability of the gum or cellulose to form a network ("activate") to suspend materials in the composition. As gas bubbles move through a structured composition, the gas bubbles disrupt and break the network that is formed by the suspending agent. This effect is even more pronounced in low viscosity (300 to 1000 mPas)

compositions. When the suspended material does not have a density that matches the density of the composition, the suspending agent is needed to keep the materials suspended within the composition. Depending on the relative density of the suspended material to the composition, the suspended material will either sink or float in the composition.

Gas can enter the composition in many ways. It can be present in the raw materials. It can be entrained during mixing. The surfactants are susceptible to generating gas in a composition.

The gas in the system can be removed before or after suspended material is added to the composition. If the degassing is done after, the suspended material that is used has to survive the degassing process such that the suspended material maintains itself. The degassing can be done by any method that removes or allows gas to be removed. When the gas is air, the process is referred to as deaeration. The degassing can be achieved by holding/storing the composition for a sufficient amount of time to allow the gas to leave the composition. Optionally, a vacuum can be applied during the holding/storing to increase the rate of degassing.

In one embodiment, the composition is degassed in a vacuum deaereator, such as the Cornell™ versator, which is available from The Cornell Machine Company of Springfield, N.J. The versator includes a vacuum chamber with a rotating disc. A spreader ring spreads material into a thin film on the disc's surface, and centrifugal forces drive the material to the disc's outer edge. Gas bubbles are then broken. More information about a versator can be found in U.S. Pat. No. 2,785,765A.

In another embodiment, the composition can be degassed in a centrifuge. When using a centrifuge, the conditions should not be so high that the suspending agent is centrifuged out. In another embodiment, the composition can be degassed by sonication.

Measuring the Amount of Gas in a Composition

The amount of gas in a composition can be measured using particle video microscopy. This device can be obtained from Mettler-Toledo of Columbia, Md. as Lasentec™ V819 with PVM™ technology. For more information on this device, see U.S. Pat. Nos. 4,871,251; 5,815,264; 5,619,043; 6,449,042; and 6,940,064.

The following procedure is used to analyze a sample of material for gas bubble content. When the gas bubble content is described throughout this specification and in the claims, this procedure is used for measuring. This test is referred to as the Gas Bubble Test.

1. APPARATUS
   - Mettler Toledo Lasentec® V819 Particle Video Microscope (PVM)
   - PVM V819 Version 9.2.0 IB4 software
   - 400 ml glass beakers
   - Mettler Toledo Static beaker stand
   - IKA Eurostar Power Control-Visc Homogenizer Model CV81 (rpm range 50-2000)
   - The PVM is equipped with a polytetrafluoroethylene reflection cap on the tip of the instrument, and the PVM is equipped with the optional backscatter laser to increase viewability.
2. PROCEDURE
   - 2.1. Operation of Mettler Toledo PVM Microscope
     - 2.1.1. Turn on PVM instrument power and computer. Wait 30 seconds for the instrument and computer to begin communication. Double click to launch the PVM On-Line Image Acquisition software.
     - 2.1.2. Select Image Analysis/Algorithms/Blob Analysis. Press the green Go button. The Blob Analysis window has 6 parameters that need to be adjusted to properly focus on the bubbles. The measurement settings are adjusted according to the specifications found in Table 1. Default settings should be used for the following: Preprocessing-Edge Filter Sobel; Output Distribution-Diameter (Spherical Eq); Delta 1 Input-Avg. Aspect Ratio; Image Analysis Window-Show Detected Particles Enabled; Overlay Result-Original Image.

TABLE 1

PVM Measurement Settings for Structured LDL

| Threshold | | Preprocessing | | Particle acceptance criteria | | Instrument Settings | |
|---|---|---|---|---|---|---|---|
| | | | | Min | Reject particles w/ellipsoidity | | |
| Lower | Upper | Decimation Factor | Filter Type | Pixel Size | less than size | Gain | Laser On |
| 2 | 50 | 2 | 5 × 5 | 50 | 60 | 50 | 6 |

2.1.3. Click on the Settings/Instrument Settings button. Set the Image Acquisition Gain between 50-55 and select Illumination Settings and set to Laser 6 only and Laser Intensity to 100.

2.2. Operation of PVM Acquisition Software 2.2.1. Once the parameters for the PVM camera have been optimized, double click to launch the Lasentec PVM Stat Acquisition 6.0 Build 11 software.

2.2.2. Within the software, create a new file to save new data by clicking the Open file for Save button. Type in the name of the file to save.

2.2.3. Click the Setup Menu/Stat. Config/Load Stats.Config button. Select the statistical analysis file that contains the specifications. This allows for a comparison between the real time data and the acceptable specification for the product. This step is optional.

2.2.4. Press the Measuring Press to Stop Button to begin viewing the bubble distribution data.

2.2.5. To begin collecting data, click the Not Saving Press to Autosave button.

2.3. Sample Preparation 2.3.1. Pour 200 ml of the sample into a glass beaker.

2.3.2. Place the beaker on the fixed beaker stand. Also be sure that the PVM probe has a polytetrafluoroethylene reflection cap on the tip to enhance the backscattered laser light back to the detector. Manual twist the IKA impeller to be sure the impeller moves freely inside the beaker and does not hit the probe or polytetrafluoroethylene cap.

2.3.3. Turn on the IKA homogenizer and adjust the RPM to between 160-170 RPM for Premix and finished product analysis. This RPM will provide a good agitation to move product through the probe without introducing bubbles into the sample. Note: always be sure the IKA homogenize is at the lowest RPM when it is turned on to avoid introducing bubbles into the sample.

3. ANALYSIS 3.1. Post Analysis of Data Using PVM Sequence Review Software 3.1.1. To analyze data after acquisition, double click on the Lasentec FBRM Data Review 6.0 Build 11 to launch the software.

3.1.2. Within the software, click on the Setup menu/Open File button and find/open the file that contains the data to be reviewed.

3.1.3. Click on the Setup Menu/Stat Config. Button and select the Load Stats Config file for the application of interest.

3.2. No calculations are required beyond what is provided in the Statistical Configuration used in the PVM Sequence Review software. During data collection and post data review, the channel grouping is fixed at 0-500 micron 100 linear in measurement range of 0-1000 micron. The Channel grouping gives the user the ability to group the primary distribution into channels that are more appropriate for the application of interest. Square weighting generally is used to analyze particle in the large size range; whereas, No weighting is used to analyze particles in the small size range. The typical distributions used to evaluate the bubble content are shown in the table below.

| 10-45 micron | 45-80 micron | 80-140 micron | 140-200 micron | 200-500 micron |
|---|---|---|---|---|
| counts/sec | counts/sec | counts/sec | counts/sec | counts/sec |

In one embodiment, an amount of air bubbles after degassing is less than 10 counts per second in at least one of the above particle size ranges according to the Gas Bubble Test. In other embodiments, the count is less than 9, less than 8, less than 7, less than 6, less than 5, less than 4, less than 3, less than 2, or less than 1 count per second. In one embodiment, the count is less than 2 counts per second. In other embodiments, the count is less than 10, or 9, or 8, or 7, or 6, or 5, or 4, or 3, or 2, or 1 in each of the particle size ranges. The above counts per second ranges apply to both linear channel measurement and log channel measurement on the apparatus.

In one embodiment, the composition has, as measured on a linear channel, the following counts:

| 10-45 micron | 45-80 micron | 80-140 micron | 140-200 micron | 200-500 micron |
|---|---|---|---|---|
| <6.2 counts/sec | <7.3 counts/sec | <3.7 counts/sec | <0.32 counts/sec | about 0 counts/sec |

In one embodiment, the composition has, as measured on a log channel, the following counts:

| 10-45 micron | 45-80 micron | 80-140 micron | 140-200 micron | 200-500 micron |
|---|---|---|---|---|
| <1 counts/sec | <3.4 counts/sec | <5.5 counts/sec | <4.6 counts/sec | <1 counts/sec |

After degassing, it is recommended for any transport of the composition before it is packaged that the transport occur with equipment that avoids reaeration of the composition.

Positive displacement pumps are one type of pump that can be used to transport the composition to packaging. These pumps avoid cavitation, which can entrain air.

Liquid Portion

The composition contains at least one surfactant. In certain embodiments, the surfactant is present in an amount that is at least 1% by weight of the composition based on the active amount of the surfactant. In other embodiments, the amount of surfactant is at least 5, 10, 20, 25, 30, 35, or 40% by weight. In another embodiment, the amount of surfactant is 1% to 45% by weight. The surfactant can be any surfactant or any combination of surfactants. Examples of surfactants include anionic, nonionic, cationic, amphoteric, or zwitterionic. For a list of surfactants and other materials that can be included in the composition, see United States Patent Publication No. 2007/0010415A1.

Water is included in the composition. The amount of water is variable depending on the amounts of other materials added to the composition.

The composition can be formulated to be any type of liquid cleansing composition. The composition can be used as a light duty liquid (LDL) dish detergent, hand soap, body wash, or a laundry detergent. One embodiment is for a LDL dish detergent.

In another embodiment, an alkaline earth metal ion is included with the microfibrous cellulose to increase the yield stress to increase the suspending ability. For further information, see U.S. application Ser. No. 61/257,940 filed on 4 Nov. 2009 entitled "MICROFIBROUS CELLULOSE AND ALKALINE EARTH METAL ION STRUCTURED SURFACTANT COMPOSITION", which is incorporated herein by reference in its entirety. In another embodiment, the microfibrous cellulose is processed to obtain a particle size distribution that increases the suspending ability. For further information, see U.S. application Ser. No. 61/257,872 filed on 4 Nov. 2009 entitled "MICROFIBROUS CELLULOSE HAVING A PARTICLE SIZE DISTRIBUTION FOR STRUCTURED SURFACTANT COMPOSITIONS", which is incorporated herein by reference in its entirety.

The compositions can be made by simple mixing methods from readily available components which, on storage, do not adversely affect the entire composition. Mixing can be done by any mixer that forms the composition. Examples of mixers include, but are not limited to, static mixers and in-line mixers.

Suspending Agents

Suspending agents are any material that increases the ability of the composition to suspend material. Examples of suspending agents include, but are not limited to, gums, gellan gum, polymeric gums, polysaccharides, pectine, alginate, arabinogalactan, carageenan, xanthum gum, guar gum, rhamsan gum, furcellaran gum, celluloses, microfibrous cellulose, and carboxymethylcellulose.

The suspending agents can be used alone or in combination. The amount of suspending agent can be any amount that provides for a desired level of suspending ability. In one embodiment, the suspending agent is present in an amount from 0.01 to 10% by weight of the composition.

In one embodiment, the suspending agent comprises gellan gum. In one embodiment, the gellan gum is present in an amount of 0.05 to 0.25 weight %. In another embodiment, the about is 0.125 weight %.

In one embodiment, the suspending agent comprises microfibrous cellulose. In one embodiment, the microfibrous cellulose is present in the composition in an amount of 0.01 to 0.12 weight %. In other embodiments, the amount is at least 0.02, 0.03, 0.04, 0.05, 0.06, 0.07, 0.08, 0.09, 0.1 up to 0.12 weight %. In one embodiment, the amount is 0.048 weight %.

In one embodiment, the suspending agent is a combination of microfibrous cellulose (MFC), xanthan gum, and carboxymethyl cellulose (CMC). This suspending agent is available from CP Kelco as Cellulon™ PX or Axcel™ CG-PX. It is a 6:3:1 blend by weight of MFC:xanthan gum:CMC. It is further described in United States Patent Publication Nos. 2008/0108714A1, 2008/0146485A1, and 2008/0108541A1. On addition of water, the xanthan gum and CMC become hydrated and provide for better dispersion of MFC. In one embodiment, the MFC:xanthan gum:CMC is present in the composition in an amount of 0.01 to 0.2 weight %. In other embodiments, the amount is at least 0.02, 0.03, 0.04, 0.05, 0.06, 0.07, 0.08, 0.09, 0.1, or 0.15 up to 0.2 weight %. In one embodiment, the amount is 0.08 weight %.

Suspended Materials

Once the composition is structured with a suspending agent, the composition can suspend suspended materials. Suspended materials are defined as water insoluble visible particles. They can be functional or non-functional (aesthetic), i.e. functional materials have components that augment the performance capabilities of the product and non-functional materials are present solely for aesthetic purposes. Functionality can often be provided by encapsulating materials that deliver functional benefits or by providing a tactile benefit (e.g. scrubbing). Functional materials, however, may also have aesthetic purposes.

The suspended material can be density matched to the liquid portion if very low viscosity is desired. Density matched means that the density of the suspended material is close to the density of the liquid portion so that the suspended material remains suspended. In one embodiment, the density of the suspended material has a density that is 97% to 103% of the density value of the liquid portion. In other embodiments, the suspend material is not density matched.

At least a portion of the suspended material is of any size that is viewable by a person. By viewable it is meant that the suspended material can be seen by a non-color blind person with an unaided eye at 20/20 or corrected to 20/20 with glasses or contact lenses at a distance of 30 cm from the composition under incandescent light, florescent light, or sunlight. In other embodiments, at least 50%, at least 60%, at least 70%, at least 80%, at least 90%, at least 95%, or at least 99% of the particles are viewable by a person. In one embodiment, the particle size is 100 to 2500 microns in a longest dimension of the suspended material. In another embodiment, the particle size is 250 to 2250 microns. In another embodiment, the particle size is 500 to 1500 microns. In another embodiment, the particle size is 700 to 1000 microns. In another embodiment, a combination of more than one particle sizes can be used.

The suspended material can have any shape. Examples of shapes include, but are not limited to, spherical, polyhedral, cubic, box, tetrahedral, irregular three dimensional shapes, flat polygons, triangles, rectangles, squares, pentagons, hexagons, octagons, stars, characters, animals, plants, objects, cars, or any other desired shape.

The suspended material can be present in any amount in the composition that allows the suspended material to remain suspended. In one embodiment, the suspended material is present in an amount of 0.01 and 10% by weight of the total composition.

The suspended material can be selected to be of one size and one shape, one size and a combination of shapes, a combination of sizes and one shape, or a combination of sizes and a combination of shapes. Also, the color of the suspended material can be varied along with the size and/or shape. Mixtures of suspended materials that vary by size, shape, and/or color can be used to communicate different attributes that the product can deliver to a consumer.

The suspended material can be functional, non-functional (aesthetic), or a combination of both. They can be made from a variety of materials such as the following non-limiting examples: gelatin, cellulose, agar, waxes, polyethylene, and insoluble inorganic materials like silica and calcium carbonate. The material may also have an encapsulate core containing hydrophobic compounds and mixtures such as these non-limiting examples: aloe, vitamins, essential oils, natural oils, solvents, esters, or any fragrance ingredient. These materials may be density matched by encapsulating oils or other materials that help make the density of the suspended material equal to that of the bulk composition. Alternatively, they may be made porous in a way that allows the liquid portion to diffuse into the suspended material in a manner that is self density matching. Density matching produces compositions that can suspend material at a viscosity less than 1500 mPas. Also, the particles may be non-density matched, that is being either less or more dense than the composition. In these compositions, the liquid portion can be designed to have a yield stress to aid in the stabilization of suspended material.

Viscosity

The composition has a viscosity that allows the composition to be pourable. In certain embodiments, the viscosity is below 10,000 mPas. Viscosity is measured using a Brookfield RVT Viscometer using spindle 21 at 20 RPM at 25° C. In one embodiment, the viscosity is less than 5,000 mPas. In other embodiments, the viscosity is less than 1,500 mPas, less than 1,000 mPas, less than 750 mPas, or less than 500 mPas.

The yield stress is measured on a TA Instruments ARG2 controlled stress rheometer utilizing a small vane (15 mm diameter) geometry and 30 mm jacketed sample cup at 25° C. with a 10,000 μm gap. A conditioning step is programmed into the creep test—after loading the sample, a two minute "relaxation" period is used in which the sample is equilibrated to 25° C. before measurements are started. The 25° C. temperature is maintained by the instrument throughout the test. Yield stress was determined utilizing a sequential creep test method. In this test, to ensure reproducibility, samples were equilibrated in a sequence of four identical stress/relaxation steps at the lowest initial stress of 0.01 Pa. Once the sample was equilibrated, a further series of stress/relaxation steps were conducted with gradually increasing applied stress until the resulting plot on creep compliance vs. time graph shows an upward curvature. At this time, the test was stopped and the stress at which the bend occurs is taken as the "yield stress". The yield stress is measured with any suspended material present. When suspended material is present, the gap is selected to provide sufficient clearance so as not to interfere with the suspended material. The 10,000 μm gap is sufficient for suspended material having a particle size up to 2,000 μm.

Stability of the Composition

When a structured surfactant composition has been degassed prior to the addition of suspended material, the effect is that the composition maintains a stable suspending system over time. This can be measured by the yield stress of the composition. Over time, the yield stress is maintained. In one embodiment, the yield stress does not decrease by more than 20% of its value over a 3 month period. In other embodiments, the period of time is at least 4, 5, 6, 7, 8, 9, 10, 12, or 18 months. In one embodiment, the drop in yield stress is less than 10% over any of the previously listed periods of time. The yield stress is measured at an initial time and then after the given period of time.

In one embodiment, the composition has a yield stress that is at least 0.3 Pa. In other embodiments, the yield stress is at least 0.5, 0.6, 0.7, 0.8, 0.9, or 1 Pa. For most suspended material, a yield stress of up to 1.5 Pa is sufficient. In other embodiments, the yield stress is 0.3 to 1.5 Pa. In other embodiments, the yield stress is 0.5 to 1.5 Pa.

Below are compositions that can be used in the process. Amounts are based on active weight of the material. While the compositions below can be used in the invention, they are not themselves the invention.

| Material | Weight % | Weight % |
|---|---|---|
| C12-15 Alcohol EO1.3:1 ammonium sulfate | 0-20 | 0-20 |
| Mg Dodecyl Benzene Sulfonate | 0-15 | 0-15 |
| Lauramidopropyldimethylamine Oxide | 0-10 | 0-10 |
| Na Dodecyl Benzene Sulfonate | 0-10 | 0-10 |
| Ethanol | 0-6 | 0-6 |
| Sodium Xylene Sulfonate | 0-5 | 0-5 |
| Myristamidopropylamine Oxide | 0-5 | 0-5 |
| Pentasodium Pentatate | 0-0.5 | 0-0.5 |
| PPG-20 Methyl Glucose Ether | 0-0.1 | 0-0.1 |
| Gellan Gum | 0.05-0.25 | 0 |
| MFC:xanthan gum:CMC (6:3:1 by weight) | 0 | 0.01-0.2 |
| Water, fragrance, and preservatives | QS | QS |
| Suspended Material | 0.05-10 | 0.05-10 |
| pH | 6-8 | |
| Viscosity | 300-1000 | |
| Yield Stress | >0.25 | |

| Material | wt/wt % |
|---|---|
| Water | QS |
| C12-15 Alcohol EO 1.3:1 Ammonium Sulfate | 12.2 |
| Mg Dodecyl Benzene Sulfonate | 9.3 |
| Lauramidopropyldimethylamine oxide | 4.3 |
| Na Dodecyl Benzene Sulfonate | 3.9 |
| Ethanol | 3.5 |
| Sodium Xylene Sulfonate (40%) | 2 |
| Myristamidopropylamine oxide | 1.4 |
| Fragrance | 0.5 |
| FD&C Green No. 3, CI42053 Dye | 0.02 |
| Gellan Gum | 0.125 |
| Pentasodium Pentetate | 0.13 |
| DMDM Hydantoin | 0.12 |
| LIPOSHERE ™ 0258 spheres (blue) | 0.5 |
| TOTAL | 100 |
| % Transmittance | at least 15% |

What is claimed is:

1. A process comprising a) mixing at least one surfactant, water, and at least one suspending agent chosen from polysaccharides, gums, and celluloses to form a liquid composition;

b) degassing the composition; and c) measuring an amount of gas in the composition according to the Gas Bubble Test.

2. The process of claim 1, wherein the suspending agent comprises gellan gum.

3. The process of claim 1, wherein the suspending agent comprises microfibrous cellulose.

4. The process of claim 1, wherein the suspending agent comprises a 6:3:1 by weight blend of microfibrous cellulose: xanthan gum:carboxymethyl cellulose.

5. The process of claim 1 further comprising mixing suspended material into the composition after degassing the composition.

6. The process of claim 1 further comprising mixing suspended material into the composition before degassing the composition, wherein the suspended material is capable of maintaining itself in the degassing step.

7. The process of claim 1, wherein the degassing occurs in a versator.

8. The process of claim 1, wherein the amount of gas bubbles when measured on a linear channel after degassing is (i) less than 6.2 counts/second in the 10-45 microns range, (ii) less than 7.3 counts/second in the 45-80 microns range, (iii) less than 3.7 counts/second in the 80-140 microns range, (iv) less than 0.32 counts/second in the 140-200 microns range, and (v) less than 1 count/second in the 200-500 microns range, optionally 0 counts/second.

9. The process of claim 8 further comprising mixing suspended material into the composition after degassing.

10. The process of claim 1, wherein the degassing occurs by allowing the composition to degas.

* * * * *